US006220262B1

(12) United States Patent
Hasebe

(10) Patent No.: US 6,220,262 B1
(45) Date of Patent: Apr. 24, 2001

(54) ROD-SHAPED TOOL

(76) Inventor: Mitsuaki Hasebe, 307,Miyatacho 3-chome, Hodogaya-ku, Yokohama-shi, Kanagawa 240-0002 (JP)

( * ) Notice: Subject to any disclaimer, the term of this patent is extended or adjusted under 35 U.S.C. 154(b) by 0 days.

(21) Appl. No.: 09/180,127

(22) PCT Filed: May 7, 1997

(86) PCT No.: PCT/JP97/01538

§ 371 Date: Apr. 26, 1999

§ 102(e) Date: Apr. 26, 1999

(87) PCT Pub. No.: WO97/41751

PCT Pub. Date: Nov. 13, 1997

(30) Foreign Application Priority Data

May 7, 1996 (JP) ..... 8-137699

(51) Int. Cl.[7] ..... A61H 3/00

(52) U.S. Cl. ..... 135/65; 135/67; 135/77; 135/84

(58) Field of Search ..... 135/65–66, 68, 135/69, 71–76, 67, 77, 84

(56) References Cited

U.S. PATENT DOCUMENTS 4,044,784 8/1977 Smith .
4,274,430 6/1981 Schaaf et al. .
4,625,742 * 12/1986 Phillips ..... 135/66
4,811,750 * 3/1989 McAllister ..... 135/66
4,899,771 2/1990 Wilkinson .
5,193,567 * 3/1993 Razny ..... 135/68
5,411,313 * 5/1995 Counihan ..... 135/66
5,433,234 * 7/1995 Lapere ..... 135/66
5,673,719 * 10/1997 Shofner ..... 135/68

* cited by examiner

*Primary Examiner*—Beth A. Stephan
(74) *Attorney, Agent, or Firm*—Burr & Brown

(57) ABSTRACT

A walking stick (10) has a rod-shaped shaft portion (14), a grip portion (15) formed at one end portion of the rod-shaped shaft portion (4) and a tip portion (16) formed at the other end portion of the rod-shaped shaft portion (14), and is structured such that in case of laying down and placing the walking stick (10) on a ground or a floor (11) along a longitudinal direction, a part (17) of the grip portion (15) is apart from the predetermined surface and the tip portion (16) is brought into contact with the predetermined surface (11), and in case of pressing the grip portion (15) to the ground or the floor (11), the grip portion (15) becomes a fulcrum and the tip portion (16) is apart from the ground or the floor (11) and stands up.

13 Claims, 8 Drawing Sheets

ROD-SHAPED TOOL

TECHNICAL FIELD

The present invention relates to a rod-shaped tool which a user can grip and use, and more particularly to a rod-shaped tool such as a walking stick and an umbrella used on the occasion of going out and walking.

BACKGROUND ART

A walking stick and an umbrella are widely used generally in a daily life. Particularly, the aged and the physically handicapped frequently use walking sticks on the occasion of going out. Further, a stick is historically old and has been widely used in a daily life all over the world.

Such a walking stick and an umbrella are very hard to be leant against a wall, and, when they are leant against the wall, they frequently lose their balance and fall down even due to a slight vibration. This is because the conventional walking stick or umbrella is very ill balanced since its grip portion gripped by the user, substantially formed in a J-shape, has only a limited point which is brought into contact with the wall surface.

Further, when the grip portion of the walking stick or the umbrella are hooked on a shelf at a predetermined height from a floor or a ground, there has frequently occurred the case of being ill balanced and easily losing their balance, thereby falling down. This is because the grip portion formed in a J-shape cannot absorb a swing motion in a widthwise direction in addition that the contact portion in the grip portion is very small.

As mentioned above, when the walking stick or the umbrella falls down on the ground or the floor, the user must bend greatly forward or bend his or her knees greatly in order to pick up the walking stick or the umbrella.

It has been hard together with a great pain when occasion demands for an aged person with physical handicap, a physically handicapped person or a person having a pain in his or her lower back to greatly bend forward or greatly bend his or her knees so as to pick up the walking stick or the umbrella falling down on the ground or the floor.

Further, when such a walking stick or an umbrella falls down in a street traffic, the user must bend greatly down or bend his or her knees in the traffic in order to pick up the walking stick or the umbrella. The aged and the physically handicapped, however, have difficulty in performing such behaviors rapidly. Accordingly, when they collide with a passenger, they are likely to fall down, and are injured thereby.

Still further, for a person who does not have handicap, it is very troublesome to pick up the walking stick or the umbrella falling down on the floor or the ground by bending down.

Furthemore, though there have been some idea which prevent the walking stick or the umbrella from falling down easily thus far, there has been no idea of making it possible for the user to grip the walking stick or the umbrella fallin down in an upright stance without bending down.

Accordingly, an object of the invention as claimed in claim 1 is to make it possible for the user to easily pick up a rod-shaped tool such as walking stick or the umbrella falling down on the ground or the floor nearly in an upright stance without bending forward by bending down or bending his or her knees.

Further, an object of the invention as claimed in claim 2 is to provide a rod-shaped tool wherein a tip portion stands up from the ground or the floor by pressing a grip portion to the ground or the floor, thereby being easily gripped by a hand.

Still further, an object of the invention as claimed in claim 3 is to provide a rod-shaped tool wherein a grip portion stands up from the ground or the floor by pressing a tip portion to the ground or the floor, thereby being easily gripped by a hand.

Furthermore, an object of the invention as claimed in claim 4 is to provide a rod-shaped tool wherein a grip portion is made to have a three-dimensional curve.

Moreover, an object of the invention as claimed in claims 9 to 10 is to provide a rod-shaped tool wherein a tip portion is made to have a three-dimensional curve.

Further, an object of the invention as claimed in claims 6 and 7 is to provide a rod-shaped tool which can stand at an angle of approximately forty-five degrees.

Still further, an object of the invention as claimed in claims 8 to 10 is to provide a rod-shaped tool which can deform a grip portion in various forms.

Furthermore, an object of the invention as claimed in claims 11 to 13 is to provided a walking stick which can be easily picked up by the user nearly in an upright stance without bending down or bending his or her knees even when the walking stick falls down.

Moreover, an object of the invention as claimed in claims 9 to 10 is to provided an umbrella which can be easily picked up by the user nearly in an upright stance without bending down or bending his or her knees even when the umbrella falls down.

DISCLOSURE OF THE INVENTION

In order to achieve the technical objects mentioned above, in accordance with the invention as claimed in claim 1, there is provided a rod-shaped tool which a user can grip and use, having one end portion being apart from a predetermined surface and the other end portion being brought into contact with the surface in case of being placed thereon along its longitudinal direction; wherein said other end portion may be apart from the surface and stand up in the state that said one end portion side works as a fulcrum in case of being pressed towards the surface.

In this case, the rod-shaped tool indicates all the tools formed in a rod shape and used by a human, which are used in relation to a daily life and a work and further in circumstances other than these. Accordingly, for example, a walking stick and an umbrella are representative.

Accordingly, in accordance with the invention as claimed in claim 1, when the rod-shaped tool falls down on the ground or the floor, by pressing the one end portion to the ground or the floor, the one end portion becomes a fulcrum in accordance with a principle of a lever and the other end portion is apart from the ground or the floor and stands up.

As a result, in accordance with the invention as claimed in claim 1, even when a user lays down or drops down the rod-shaped tool on the ground or the floor, he or she can easily pick it up nearly in an upright stance without bending down or bending his or her knees.

In accordance with the invention as claimed in claim 2, there is provided a rod-shaped tool which a user can grip and use, comprising a rod-shaped shaft portion, a grip portion which is formed at one end portion of the rod-shaped shaft portion, and a tip portion which is formed at the other end portion of the rod-shaped shaft portion, wherein said grip portion is apart from a predetermined surface and said tip portion is brought into contact with the surface in case of being placed thereon along its longitudinal direction, and wherein said tip portion may be apart from the surface and stand up in the state that said grip portion side works as a fulcrum in case of being pressed towards the surface.

Accordingly, in accordance with the invention as claimed in claim 2, when the rod-shaped tool falls down on the ground or the floor, by pressing the grip portion to the ground or the floor, the grip portion becomes a fulcrum in accordance with a principle of a lever and the tip portion is apart from the ground or the floor and stands up.

As a result, in accordance with the invention as claimed in claim 2, the tip portion can stand up from the ground or the floor by pressing the grip portion to the ground or the floor so that the user can easily grip it with his or her hand.

In accordance with the invention as claimed in claim 3, there is provided a rod-shaped tool which a user can grip and use, comprising a rod-shaped shaft portion, a tip portion which is formed at one end portion of the rod-shaped shaft portion, and a grip portion which is formed at the other end portion of the rod-shaped shaft portion, wherein said tip portion is apart from a predetermined surface and said grip portion is brought into contact with the surface in case of being placed thereon along its longitudinal direction; and wherein said grip portion may be apart from the surface and stand up in the state that said tip portion side works as a fulcrum in case of being pressed towards the surface.

Accordingly, in accordance with the invention as claimed in claim 3, when the rod-shaped tool falls down on the ground or the floor, by pressing the tip portion to the ground or the floor, the tip portion becomes a fulcrum in accordance with a principle of a lever and the grip portion is apart from the ground or the floor and stands up.

As a result, in accordance with the invention as claimed in claim 3, the grip portion can stand up from the ground or the floor by pressing the tip portion to the ground or the floor so that the user can easily grip it with his or her hand.

In accordance with the invention as claimed in claim 4, said grip portion is formed substantially in a J-shape from side view thereof, and is provided with a first curved portion which is once twisted to one side perpendicular to an axis of said rod-shaped shaft portion at a predetermined angle and a second curved portion which continuously extends to the first curved portion and is twisted to the other side perpendicular to the axis at a predetermined angle.

Accordingly, in accordance with the invention as claimed in claim 4, the grip portion, which is apart from the predetermined surface in case of being placed thereon along its longitudinal direction, is contituted by the first curved portion which is once twisted to one side perpendicular to the axis of the rod-shaped shaft portion at a predetermined angle and the second curved portion which continuously extends to the first curved portion and is twisted to the other side perpendicular to the axis at a predetermined angle.

As a result, in accordance with the invention as recited in claim 4, there is provided a rod-shaped tool wherein a grip portion has a three-dimensional curve.

In accordance with the invention as claimed in claim 5, said tip portion is formed substantially in a J-shape from side view thereof, and is provided with a first curved portion which is once twisted to one side perpendicular to an axis of said rod-shaped shaft portion at a predetermined angle and a second curved portion which continuously extends to the first curved portion and is twisted to the other side perpendicular to the axis at a predetermined angle.

Accordingly, in accordance with the invention as claimed in claim 5, the tip portion, which is apart from the predetermined surface in case of being placed thereon along its longitudinal direction, is contituted by the first curved portion which is once twisted to one side perpendicular to the axis of the rod-shaped shaft portion at a predetermined angle and the second curved portion which continuously extends to the first curved portion and is twisted to the other side perpendicular to the axis at a predetermined angle.

As a result, in accordance with the invention as recited in claim 5, there is provided a rod-shaped tool wherein a tip portion has a three-dimensional curve.

In accordance with the invention as claimed in claim 6, said second curved portion is twisted at an angle of approximately forty-five degrees with respect to said rod-shaped shaft portion.

Accordingly, in accordance with the invention as claimed in claim 6, when the rod-shaped tool drops down on the ground or the floor, the rod-shaped shaft portion can be stood up at an angle of approximately forty-five degrees by pressing the second curved portion to the ground or the floor.

As a result, in accordance with the invention as recited in claim 6, the user can easily grip the rod-shaped tool standing at an angle of approximately forty-five degrees nearly in an upright stance.

In accordance with the invention as claimed in claim 7, said second curved portion is twisted at an angle of approximately forty-five degrees with respect to said rod-shaped shaft portion.

Accordingly, in accordance with the invention as claimed in claim 7, when the rod-shaped tool drops down on the ground or the floor, the rod-shaped shaft portion can be stood up at an angle of approximately forty-five degrees by pressing the tip portion to the ground or the floor.

As a result, in accordance with the invention as recited in claim 7, the user can easily grip the rod-shaped tool standing at an angle of approximately forty-five degrees nearly in an upright stance.

In accordance with the invention claimed in claim 8, said grip portion is formed substantially in a trapezoidal shape in plan view.

As a result, in accordance with the invention as claimed in claim 8, there is provided a rod-shaped tool wherein the grip portion is formed substantially in a trapezoidal shape in plan view.

In accordance with the invention claimed in claim 9, said grip portion is formed in a T-shape.

As a result, in accordance with the invention as claimed in claim 9, there is provided a rod-shaped tool wherein the grip portion is formed in a T-shape.

In accordance with the invention claimed in claim 10, said grip portion is formed in an L-shape.

As a result, in accordance with the invention as claimed in claim 9, there is provided a rod-shaped tool wherein the grip portion is formed in an L-shape.

In accordance with the invention as claimed in claims 11 to 13, said rod-shaped tool is formed as a walking stick used for walking.

As a result, in accordance with the invention as claimed in claims 11 to 13, there is provided a walking stick which the user can easily picked up nearly in an upright stance without bending down or bending his or her knees when it falls down on the ground or the floor.

In accordance with the invention as claimed in claims 9 to 10, said rod-shaped tool is formed as an umbrella.

As a result, in accordance with the invention as claimed in claims 9 to 10, there is provided an umbrella which the user can easily picked up nearly in an upright stance without bending down or bending his or her knees when it falls down on the ground or the floor.

BEST MODE FOR CARRYING OUT THE INVENTION

In order to explain the invention more particularly, the invention will be described with reference to the accompanying drawings.

Figure 1:
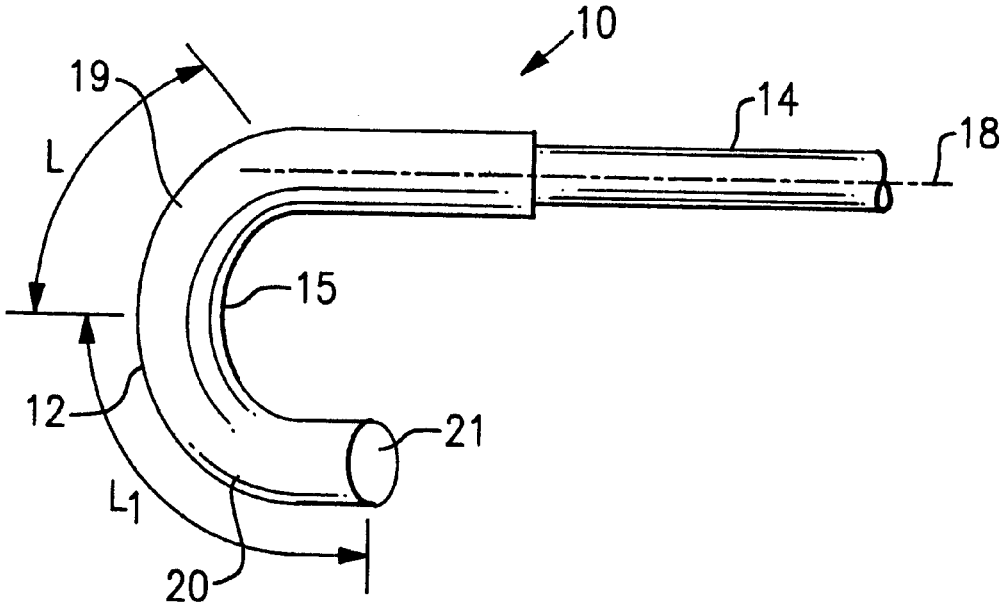
FIG. 1 is a plan view showing an embodiment in which a rod-shaped tool in accordance with the invention is applied to a walking stick.
Figure 4:
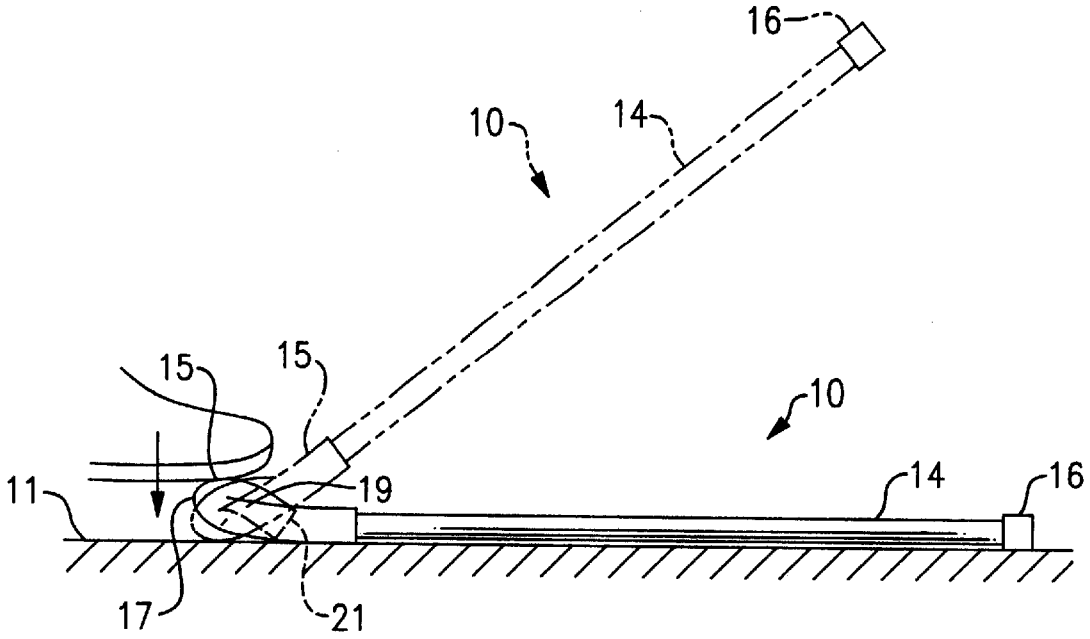
FIG. 4 is a lateral view showing an embodiment in which a rod-shaped tool in accordance with the invention is applied to a walking stick and corresponds to a schematic view which shows a state of standing the walking stick after falling down on a ground or a floor.
Figure 5:
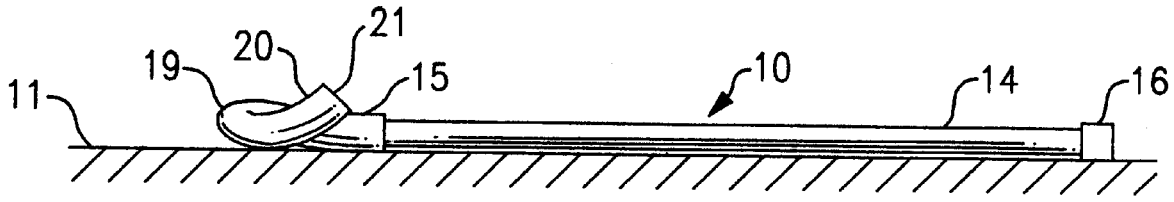
FIGS. 5 and 6 are a lateral view and a front view, respectively, showing an embodiment in which a rod-shaped tool in accordance with the invention is applied to a walking stick and correspond to schematic views which show a state that the walking stick falls down on the ground or the floor.
Figure 6:
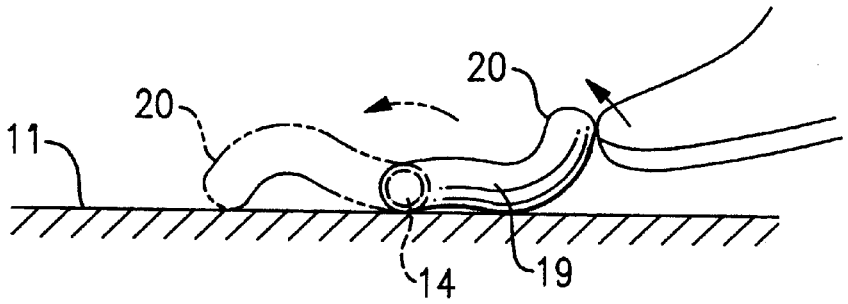

In accordance with an embodiment, as shown in FIGS. 1 and 4, a rod-shaped tool capable of being gripped and used by a user is formed as a walking stick 10.

The walking stick 10 has a rod-shaped shaft portion 14, a grip portion 15 formed at one end portion of the rod-shaped shaft portion 14 and a tip portion 16 formed at the other end portion of the rod-shaped shaft portion 14. The walking stick 10 is structured such that when it is laid down and placed on a ground or a floor 11 along its longitudinal direction, a part 17 of the grip portion 15 is apart from the ground or the floor 11 and the tip portion 16 is brought into contact with the ground or the floor 11. Therefore, when the grip portion 15 is pressed to the ground or the floor 11, the grip portion 15 becomes a fulcrum and the tip portion 16 is apart from the ground or the floor 11 and stands up.

As shown in FIG. 1, the grip portion 15 is formed substantially, in a J-shape in a plan view. The grip portion 15 is once twisted to a side perpendicular to an axis 18 of the rod-shaped shaft portion 14 at a predetermined angle, and is further continuously twisted to the other side perpendicular to the axis 18 at a predetermined angle.

Accordingly, a first curved portion 19 is formed along a predetermined length L by being once twisted perpendicularly to an extending direction of the grip portion 15 at the predetermined angle, and further a second curved portion 20 is continuously formed along a length L1 slightly longer than that of the first curved portion 19 by being twisted oppositely to the first curved portion 19 at the predetermined angle perpendicularly to the extending direction of the grip portion 15.

Figure 2:
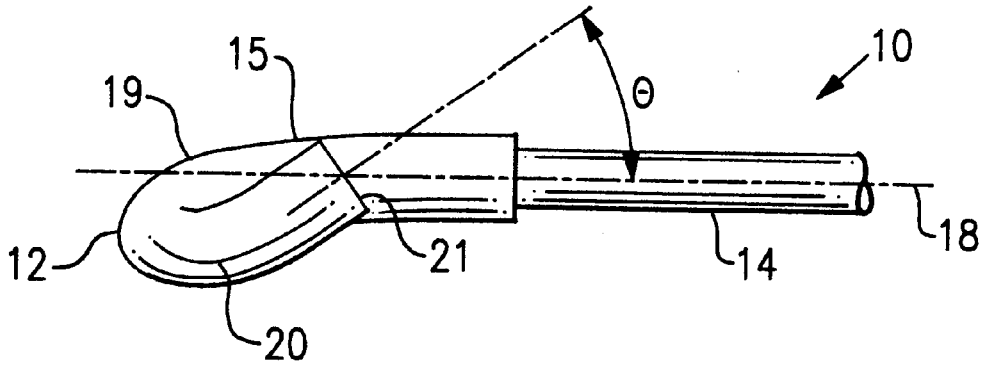
FIG. 2 is a lateral view showing an embodiment in which a rod-shaped tool in accordance with the invention is applied to a walking stick.
Figure 3:
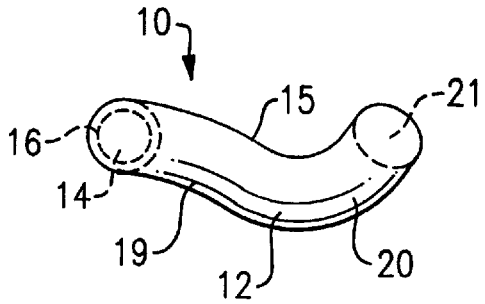
FIG. 3 is a front view showing an embodiment in which a rod-shaped tool in accordance with the invention is applied to a walking stick.

Accordingly, the first curved portion 19 and the second curved portion 20 are formed by being twisted in the direction opposite to each other. Therefore, the grip portion 15 forms a gentle S-shape as shown in FIG. 3 when the curved portions 19 and 20 are seen from the direction of the curved end 12 of the grip portion 15, and as shown in FIG. 2, a terminal end 21 of the grip portion 15 is located slightly outward from the rod-shaped shaft portion 14 in lateral view of the grip portion 15.

As a result, in the grip portion 15 of the walking stick 10 in accordance with the embodiment, the first curved portion 19 and the second curved portion 20 function as a balancer, and are structured such as to be capable of effectively absorbing a force generated by an oscillation in a direction perpendicular to the rod-shaped shaft portion 14. Moreover, in accordance with the embodiment, the second curved portion 20 is structured such that an angle θ with respect to the axis 18 becomes about forty-five degrees.

An operation of the walking stick 10 in accordance with the embodiment will be described below.

During the use of the walking stick 10 in accordance with the embodiment, when the walking stick 10 drops down on the ground or the floor 11, the user can pick up the walking stick 10 by stepping on the grip portion 15 with his or her foot so that the tip portion 16 stands up with making the grip portion 15 a fulcrum.

Accordingly, as shown in FIG. 4, when the walking stick 10 drops down with its curved portions 19 and 20 upward, the user can stamp down the curved portions 19 and 20 to the ground or the floor 11; for a gap is formed between the curved portions 19 and 20 and the ground or the floor 11.

In this case, at first, the tip portion 16 begins to be apart from the ground or the floor 11 around the terminal end 21 as a fulcrum, so that the walking stick 10 begins to stand up with its tip portion 16.

The standing movement of the walking stick 10 stops at a time when the curved end 12 touches the ground or the floor 11; however, as mentioned above, since the second curved portion 20 is structured in such a manner as to form an angle of forty-five degrees with respect to the rod-shaped shaft portion 14, the rod-shaped shaft portion 14 stands up at an angle of approximately forty-five degrees around the curved end 12 as a fulcrum.

As a result, the user can easily grip the rod-shaped shaft portion 14 in an upright stance with his or her hand without bending down or bending his or her knees.

Figure 8:
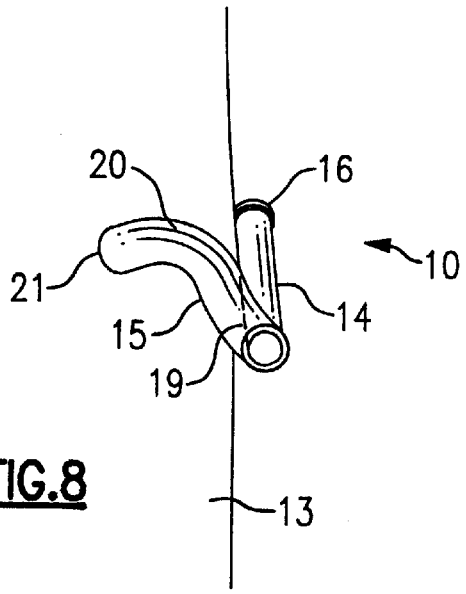
FIG. 8 is a plan view showing an embodiment in which a rod-shaped tool in accordance with the invention is applied to a walking stick and corresponds to a schematic view which shows a state of being hooked on a shelf.
Figure 9:
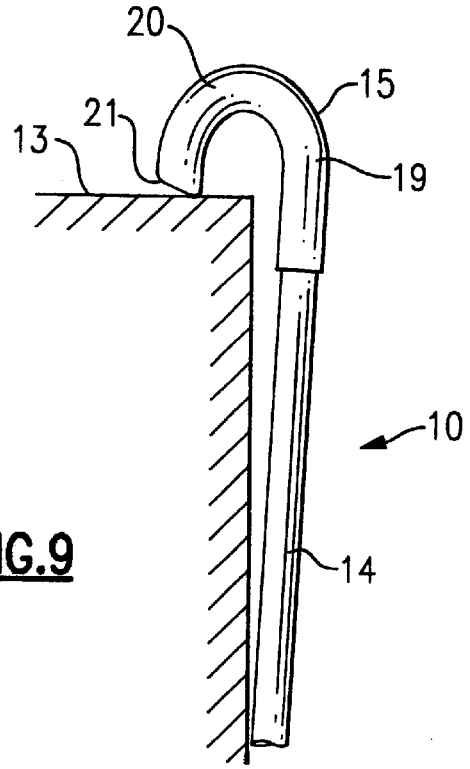
FIG. 9 is a lateral elevational view showing an embodiment in which a rod-shaped tool in accordance with the invention is applied to a walking stick and corresponds to a schematic view which shows a state of being hooked on the shelf.

Further, as shown in FIGS. 8 and 9, in case of hooking the walking stick 10 in accordance with the embodiment on the shelf 13 provided at a predetermined height from the ground or the floor 11 by its terminal end, as mentioned above, the first curved portion 19 and the second curved portion 20 serve as a balancer, and can effectively absorb an oscillation.

Accordingly, even in case of hooking the walking stick 10 on the shelf 13 temporarily, it is possible to effectively absorb an oscillation of the walking stick 10 generated at a time of hooking. As a result, in case of hooking the walking stick 10 at the grip portion 15, the walking stick 10 can be stably hooked, thereby being prevented from dropping down.

Figure 7:
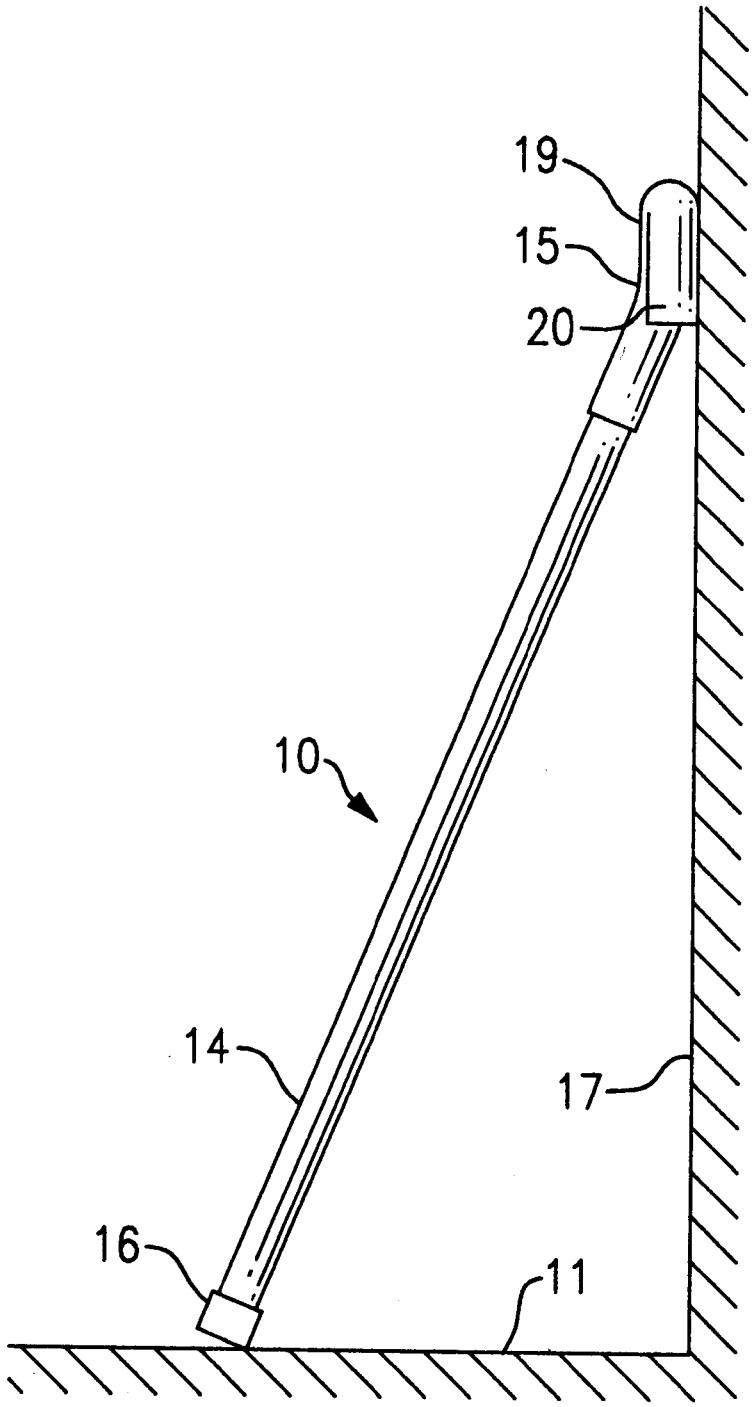
FIG. 7 is a lateral elevational view showing an embodiment in which a rod-shaped tool in accordance with the invention is applied to a walking stick and corresponds to a schematic view which shows a state of being leant against a wall.

Further, as shown in FIG. 7, in case of leaning the walking stick 10 against the wall 17, since the first curved portion 19 and the second curved portion 20 are wholly formed in a substantially S-shape, the grip portion 15 can totally form a plurality of contact points to a surface of the wall 17, so that the walking stick 10 can be more stably leant against the wall 17 compared with the conventional walking stick formed in a J-shape in plan view.

Still further, as mentioned above, since the grip portion 15 is totally formed in an S-shape and has the first curved portion 19 and the second curved portion 20, in case that the user grips the grip portion 15, a plurality of force points are formed in a thickness direction of the grip portion 15 so that the grip portion 15 is gripped more easily than the conventional art formed in a J-shape in plan view. As a result, since the walking stick 10 can be easily fixed, the user easily holds his or her body using the walking stick 10.

Figure 10:
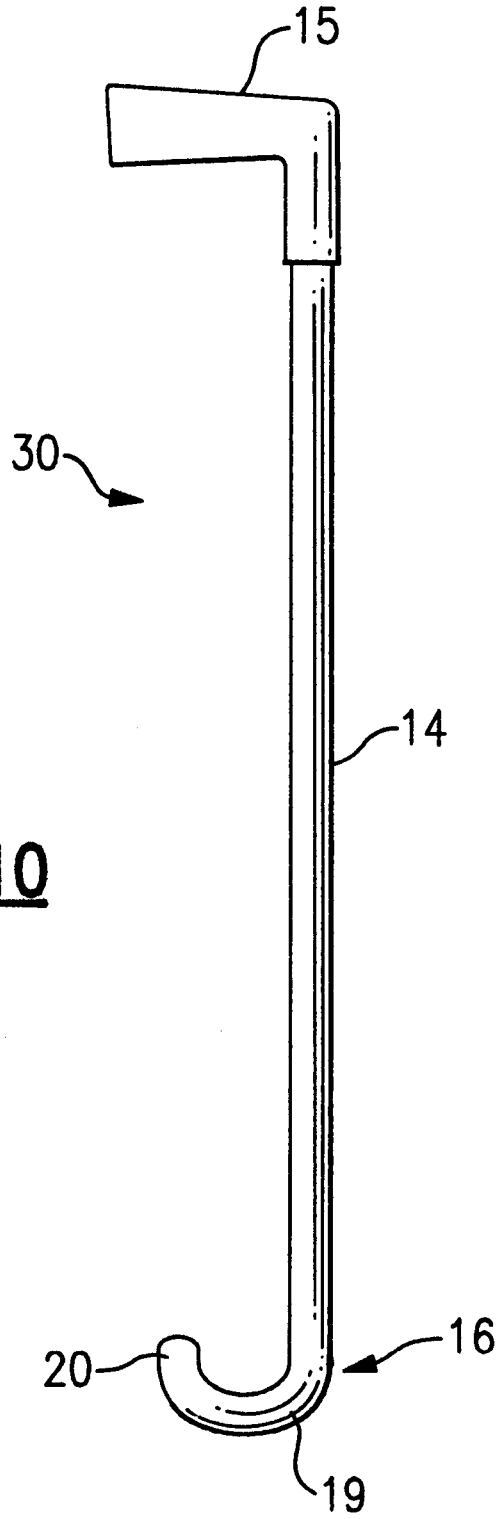
FIG. 10 is a lateral elevational view showing the other embodiment in which a rod-shaped tool in accordance with the invention is applied to a walking stick.

In this case, in accordance with the embodiment mentioned above, the description is given as an example to the case that the first curved portion 19 once twisted at a predetermined angle to the one side perpendicular to the axis 18 of the rod-shaped shaft portion 14 and the second curved portion 20 continuously extending to the first curved portion 19 and twisted at a predetermined angle to the other side perpendicular to the axis 18 are provided in the grip portion 15. The invention, however, is not limited to the embodiment mentioned above, and as shown in FIG. 10, the first curved portion 19 and the second curved portion 20 may be provided in the tip portion 16 of a walking stick 30.

As mentioned above, in case that the first curved portion 19 and the second curved portion 20 are provided in the tip portion 16, as is different from the embodiment mentioned above, the user can pick up the walking stick 30 by gripping the grip portion 15 with his or her hand when the walking stick 30 having fallen down on the ground or the floor 11 stands up.

Accordingly, in accordance with the embodiment, the user can pick up the walking stick 30 without dirtying his or her hand.

Figure 11:
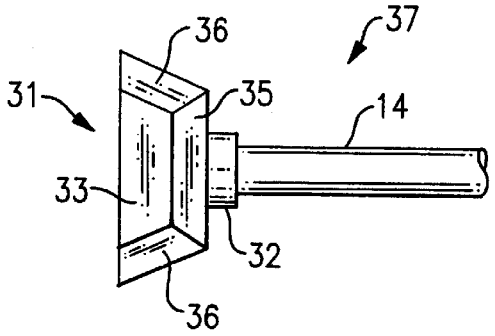
FIG. 11 is a plan view showing the other embodiment in which a rod-shaped tool in accordance with the invention is applied to a walking stick.
Figure 12:
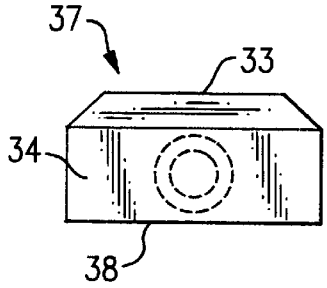
FIG. 12 is a front view showing the other embodiment in which a rod-shaped tool in accordance with the invention is similarly applied to a walking stick.

Further, the description is given to the case that the the grip portion 15 of the walking stick 10 mentioned above is formed substantially in a J-shape; however, the invention is not limited to the embodiment, and the grip portion 31 may be formed substantially in a trapezoidal shape in plan view as a walking stick 37 shown in FIG. 11.

A grip portion 31 in accordance with the embodiment is formed substantially in a trapezoidal shape in plan view, and is connected to the rod-shaped shaft portion 14 in such a manner as to form an inverted trapezoidal shape. The rod-shaped shaft portion 14 mentioned above is fixed at a lower end portion of the grip portion 31 with a connecting portion 32.

Figure 13:
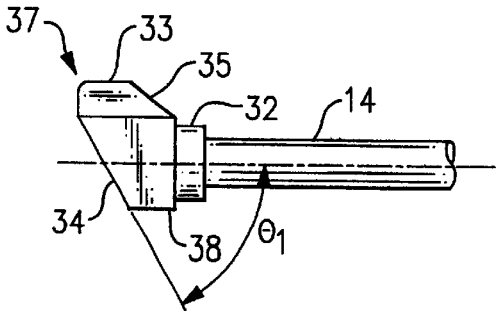
FIG. 13 is a lateral view showing the other embodiment in which a rod-shaped tool in accordance with the invention is similarly applied to a walking stick.
Figure 14:
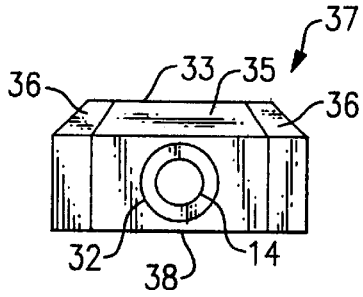
FIG. 14 is a side elevational view showing the other embodiment in which a rod-shaped tool in accordance with the invention is similarly applied to a walking stick.

The grip portion 31 is, as shown in FIG. 13, provided with a grounded surface 34 which inclined so as to cut in a direction to the connecting portion 32 from a stamping surface 33, which forms a front surface, toward a back surface 38. The grip portion 31 is also provided with a grip surface 35 inclining to the connecting portion 32 so as to oppose to the grounded surface 34. In this case, in accordance with the embodiment, an angle θ1 between the rod-shaped shaft portion 14 and the grounded surface 34 is formed as approximately forty-five degrees.

Further, inclined portions 36 and 36, both of which inclined at almost the same angle as that of the grip surface 35, are formed on both end of the grip surface 35, so that, as a whole, both of the lateral sides and the lower side of the stamping surface 33 are in a state of being beveled at a predetermined angle.

An operation of the walking stick 37 structured in the above manner will be described below.

During the use of the walking stick 37 in accordance with the embodiment, the grip portion 31 mentioned above is gripped. In this case, since the grounded surface 34 comprising the inclined surface mentioned above and the grip surface 35 provided in opposite to the grounded surface 34 are provided, fingers can easily go around the grip portion 31, so that the user can easily grip.

Figure 15:
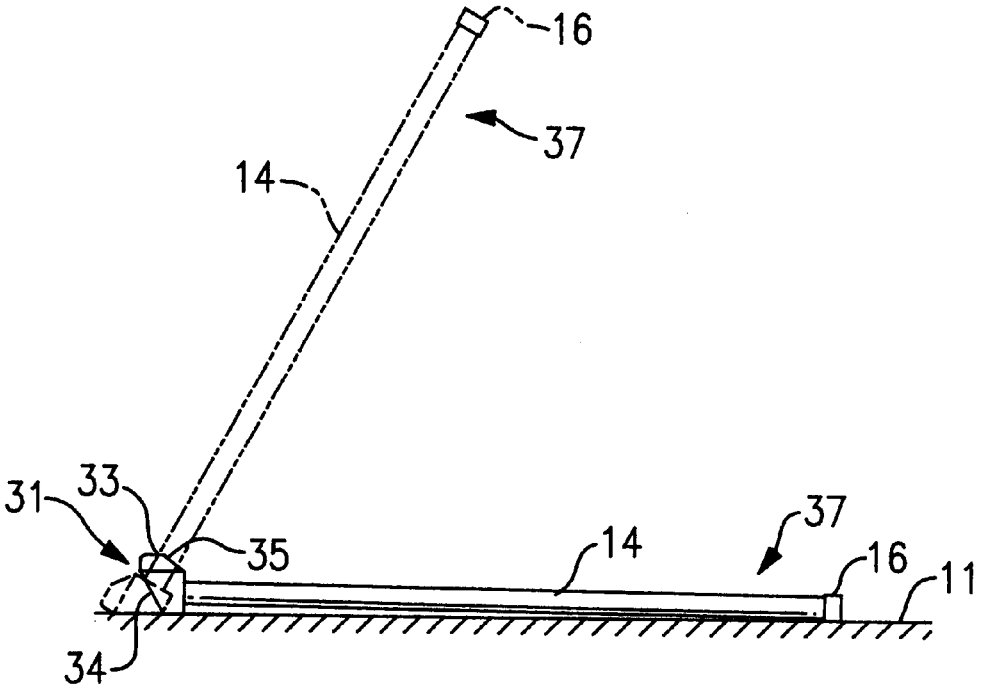
FIG. 15 is a side elevational view showing the other embodiment in which a rod-shaped tool in accordance with the invention is similarly applied to a walking stick and corresponds to a schematic view which shows a state of standing the walking stick after falling down on the ground or the floor.

Further, when the walking stick 37 falls down on the ground or the floor 11, as shown in FIG. 15, the stamping surface 33 mentioned above is stamped toward a tip direction of the grip portion 31 by a foot. In this case, since a portion between the ground or the floor 11 and the grounded surface 34 is formed at an angle of approximately forty-five degrees, while the grounded surface 34 is grounded on the ground or the floor 11, it stands up from the tip portion 16 and stands up from the ground or the floor 11 at about forty-five degrees.

Accordingly, in the same manner as the embodiment mentioned above, the user can easily grip the rod-shaped shaft portion 14 and can pick up the walking stick 37 in an upright stance without bending down or bending his or her knees.

Figure 16:
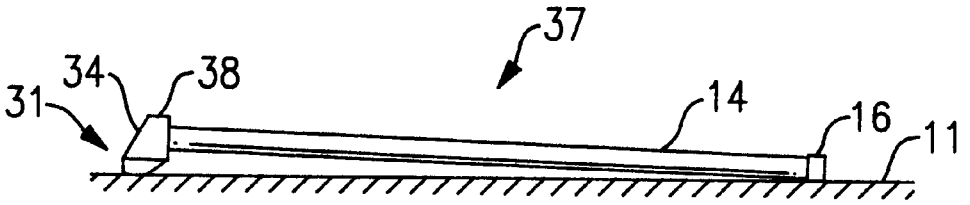
FIG. 16 is a schematic view showing the other embodiment in which a rod-shaped tool in accordance with the invention is similarly applied to a walking stick and showing a state that the walking stick falls down on the ground or the floor.

In this case, as shown in FIG. 16, when the walking stick 37 falls down on the ground or the floor 11 with its grounded surface 34 upward, one side of the back surface 38 can be stamped and the walking stick 37 can be turned over so that the stamping surface 33 looks upward, and then the walking stick 37 stands up in accordance with the same procedure as those mentioned above. In this case, since the inclined portions 36 and 36 are formed in the grip portion 31, it can be easily turned over.

Further, the aspect of the grip portion is not limited to the embodiments mentioned above, and may be formed in a T-shape or an L-shape.

Still further, in each of the embodiments mentioned above, the description is given to the case in which the invention is applied to the walking stick; however, the invention is not limited to the embodiments mentioned above, and the invention may be applied to an umbrella.

In case that a grip portion of the umbrella is, for example, formed substantially in a J-shape in a side surface as mentioned above and provided with a first curved portion once twisted at a predetermined angle to one side perpendicular to the axis of the rod-shaped shaft portion mentioned above and a second curved portion continuously extending to the first curved portion and twisted at a predetermined angle to the other side perpendicular to the axis, as mentioned above, the grip portion can be easily gripped and further, the first curved portion and the second curved portion constitute a plurality of hooking portions within the palm of the hand, so that the user can more firmly support the umbrella in comparison with the umbrella having the grip portion formed in a J-shape in plan view, which is generally and widely sold in case that a strong wind blows from various directions.

INDUSTRIAL APPLICABILITY

As mentioned above, the rod-shaped tool in accordance with the invention can be widely applied to a rod-shaped object which a human grips by a hand and uses in addition to a rod-shaped daily necessaries such as a walking stick and an umbrella used in a daily life.

What is claimed is:

1. A rod-shaped tool which a user can grip and use, comprising:

a rod-shaped shaft portion;

a grip portion which is formed at one end portion of the rod-shaped shaft portion; and a tip portion which is formed at an other end portion of the rod-shaped shaft portion;

wherein said grip portion is spaced apart from a predetermined plane and a remaining portion of said rod-shaped shaft portion including said tip portion extends within said plane; and wherein, when said rod-shaped tool is placed on a physical surface coincident with said plane, the remaining portion of said rod-shaped shaft contacts said surface and said tip portion separates from said surface as said grip portion, working as a fulcrum, is pressed towards said surface.

2. A rod-shaped tool as claimed in claim 1, wherein said grip portion is formed substantially in a J-shape from side angle thereof, and is provided with a first curved portion which is once twisted to one side perpendicular to an axis of said rod-shaped shaft portion at a predetermined angle and a second curved portion which continuously extends to the first curved portion and is twisted to another side perpendicular to said axis at a predetermined angle.

3. A rod-shaped tool as claimed in claim 2, wherein said second curved portion is twisted at an angle of approximately forty-five degrees with respect to said rod-shaped shaft portion.

4. A rod-shaped tool as claimed in claim 1, wherein said grip portion is formed substantially in a trapezoidal shape in plan view.

5. A rod-shaped tool as claimed in claim 1, wherein said grip portion is formed in a T-shape.

6. A rod-shaped tool as claimed in claim 1, wherein said grip portion is formed in a L-shape.

7. A rod-shaped tool as claimed in claim 1, wherein said rod-shaped tool is formed as a walking stick used for walking.

8. A rod-shaped tool as claimed in claim 1, wherein said rod-shaped tool is formed as an umbrella.

9. A rod-shaped tool which a user can grip and use, comprising:

a rod-shaped shaft portion;

a tip portion which is formed at one end portion of the rod-shaped shaft portion; and a grip portion which is formed at an other end portion of the rod-shaped shaft portion;

wherein said tip portion is spaced apart from a predetermined plane and a remaining portion of said rod-shaped shaft portion including said grip portion extends within said plane; and wherein when said rod-shaped tool is placed on a physical surface coincident with said plane, the remaining portion of said rod-shaped shaft contacts said surface and said grip portion separates from said surface as said tip portion, working as a fulcrum, is pressed towards said surface.

10. A rod-shaped tool as claimed in claim 9, wherein said tip portion is formed substantially in a J-shape from a side angle thereof, and is provided with a first curved portion which is once twisted to one side perpendicular to an axis of said rod-shaped shaft portion at a predetermined angle and a second curved portion which continuously extends to the first curved portion and is twisted to another side perpendicular to said axis at a predetermined angle.

11. A rod-shaped tool as claimed in claim 10, wherein said second curved portion is twisted at an angle of approximately forty-five degrees with respect to said rod-shaped shaft portion.

12. A rod-shaped tool as claimed in claim 9, wherein said rod-shaped tool is formed as a walking stick used for walking.

13. A rod-shaped tool as claimed in claim 9, wherein said rod-shaped tool is formed as an umbrella.

* * * * *